US005251858A

United States Patent [19]

Ultee

[11] Patent Number: 5,251,858

[45] Date of Patent: Oct. 12, 1993

[54] WOBBLE-RESISTING FURNITURE

[76] Inventor: Arnoldus J. Ultee, 816 Gwynne Ave., Waynesboro, Va. 22980

[21] Appl. No.: 890,231

[22] Filed: May 29, 1992

[51] Int. Cl.[5] ..... A47B 9/00

[52] U.S. Cl. ..... 248/188.3

[58] Field of Search ..... 248/188.3, 188.2, 188.5, 248/188.8

[56] References Cited

U.S. PATENT DOCUMENTS

| | | | |
|---|---|---|---|
| 1,559,234 | 10/1925 | Fleming | 248/188.2 |
| 1,798,272 | 3/1931 | Phillips | 248/188.2 |
| 2,176,255 | 10/1939 | Frost | 248/188.3 |
| 2,683,576 | 7/1954 | Miller | 248/188.3 |
| 2,775,849 | 1/1957 | Ingram | 248/188.3 |
| 3,827,663 | 8/1974 | Hinman | 248/188.3 |

FOREIGN PATENT DOCUMENTS

| | | | |
|---|---|---|---|
| 394848 | 7/1933 | United Kingdom | 248/188.3 |

*Primary Examiner*—Scott Smith

[57] ABSTRACT

A wobble-resistant piece of furniture, such as a table, with at least four legs, one of the legs being weighted with respect to the others, and a shorter opposite leg having an extending member automatically extending to the floor.

3 Claims, 2 Drawing Sheets

WOBBLE-RESISTING FURNITURE

BACKGROUND OF THE INVENTION

1. Field of the Invention

Figure 1:
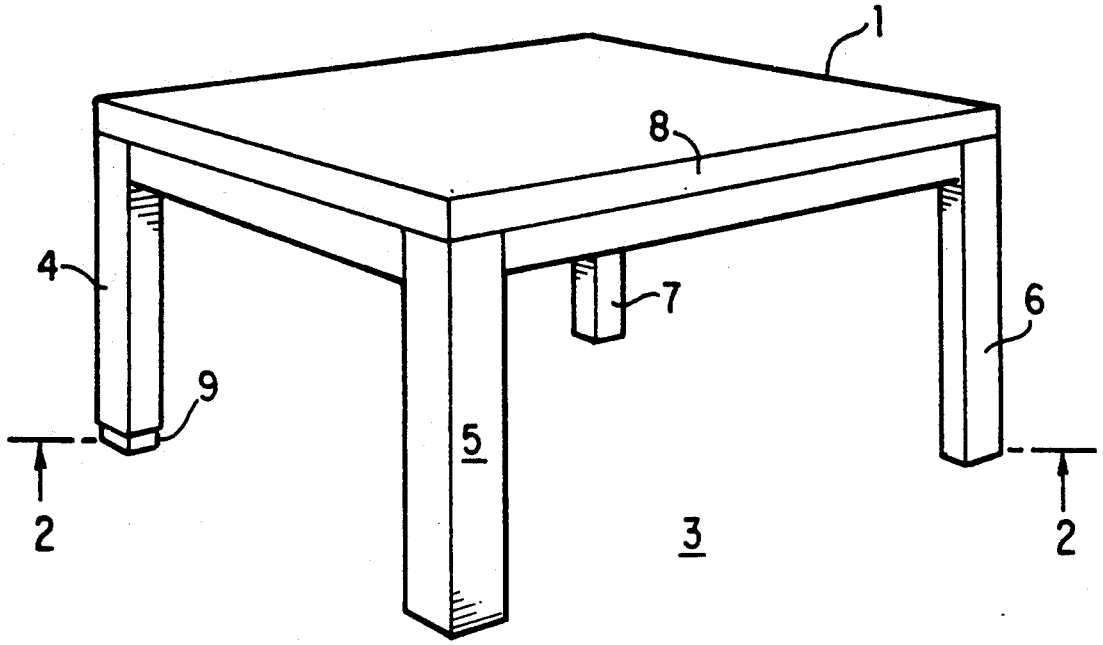

The present invention pertains to furniture, such as tables, chairs, bureaus, chests, etc. having at least four legs, which furniture would, in the absence of the invention, have a tendency to wobble or rock when placed on an uneven surface.

2. Description of the Prior Art

The problem of wobbling furniture has been recognized for a long time and various means of countering such rocking have been proposed in the patent literature. However, none of these inventions seem to have resulted in significant commercial manufacture of non-wobbling furniture because either the proposed means were not effective, too cumbersome, or complicated and expensive to fabricate. It has generally been recognized, that to make furniture with four or more legs wobble-resistant, at least two legs need to be modified. If only one leg is modified, it has to be one of the wobbling pair, and the only way to ensure this is to make one leg shorter than the other legs, but with a length-adjusting insert, as in the table disclosed in U.S. Pat. No. 1,826,578. However, after the length of the adjustable leg has been secured for one floor location of the table, it must be readjusted any time the table is moved to a different floor location where all four legs do not touch the ground. If the extension of the modified leg is automatic, by making it spring-loaded as shown in U.S. Pat. No. 3,827,663, the spring must be carefully adjusted to make it strong enough to prevent wobbling of the modified leg with its opposite leg, yet not so strong that it will lift its side of the table and cause wobbling between the other two legs. It has therefore been recognized that self-adjusting wobble-resistant furniture generally requires modification of at least two legs. The earliest patents on wobble-resistant furniture involve modification of two adjacent legs. For example, U.S. Pat. Nos. 467,811 and 520,432 to W. J. Humphreys describe means to connect adjacent legs of four-legged furniture in such a way that as one leg moves down the other moves upward to correct any wobbling caused by one of these legs initially not touching the ground. In these and numerous later patents based on the same principle, the interaction of the adjacent legs is achieved by various mechanical, hydraulic or electronic means which make such furniture expensive to construct and maintain. The same can be said of wobble-resistant furniture involving modification of two or more non-adjacent legs in such a way that there is a connection between these legs for mutual length adjustment. If there is no connection between the movement of the legs, separate manual adjustments are usually required. For example, U.S. Pat. No. 1,224,156 describes a table leg leveler where two or more legs have inserts connected to springs and provided with releasable ratchets to hold the legs extended to the ground. Manual adjustment of the length of each adjustable leg that does not touch the floor is required to prevent the table from wobbling. In the description of wobble-resistant furniture in U.S. Pat. No. 2,204,077, gravity is mentioned as a force to extend an adjustable leg under the weight of its insert, which by itself does not adequately stabilize the table.

SUMMARY OF THE PRESENT INVENTION

The present invention provides wobble-resistant furniture for placement on a floor, said furniture having at least four essentially vertically disposed legs, one of said legs being weighted relative to the leg opposite thereto, said opposite leg being shorter than the other legs and having a vertically extending member operatively connected to said opposite leg, said extending member automatically extending to said floor.

The principle of the invention will become clearer from the description of the drawings and preferred embodiments which follows.

DESCRIPTION OF THE DRAWINGS AND PREFERRED EMBODIMENTS

FIG. 1 is a perspective view of a table of the present invention.

Figure 2:
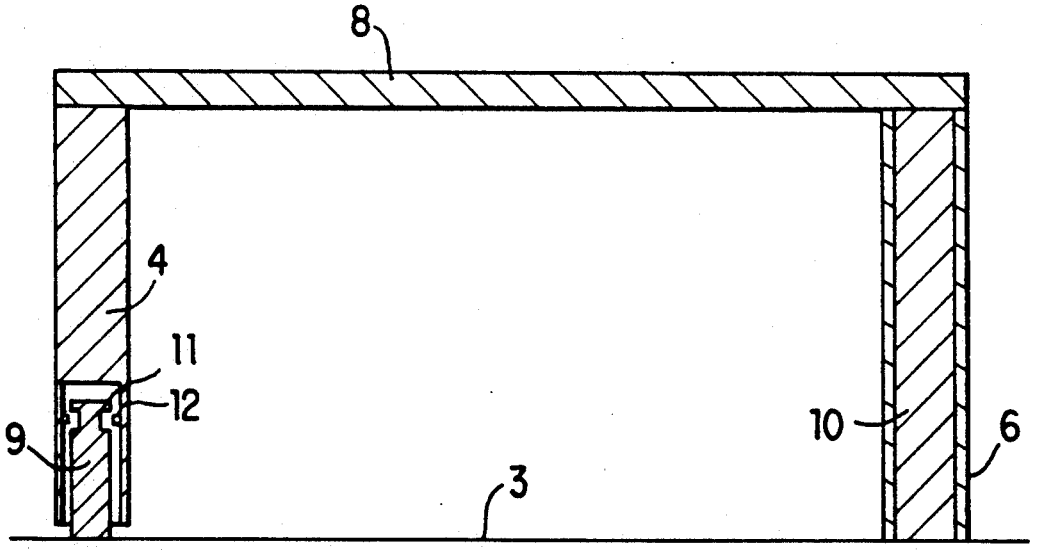

FIG. 2 is a schematic view of a diagonal cross-section of the table of FIG. 1 through legs 4 and 6, in the direction indicated by the arrows 2.

Figure 3:
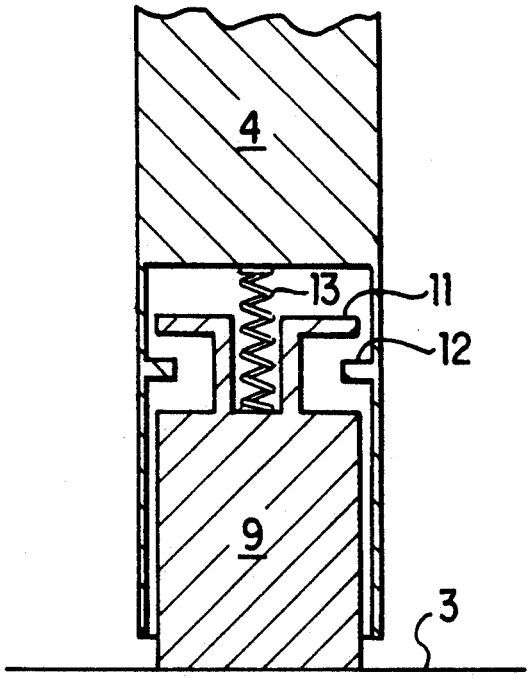

FIG. 3 is a partial cross-sectional view, in the same direction as FIG. 2, of leg 4 of FIG. 1, but showing an embodiment of this invention different from that shown in FIG. 2.

Referring now to FIG. 1 in more detail: rectangular table 1, placed on floor 3, comprises four legs numbered 4–7 connected to top 8. Leg 6 is weighted to be heavier than the other legs. Leg 4, opposite to leg 6, is shorter than the other legs. Vertically extending member 9, operatively connected to leg 4, extends to floor 3.

The weighting of leg 6 is preferably and most effectively accomplished by filling it with a heavy metal such as lead which has a specific gravity of 11.34 grams per cubic centimeter. For example, a leaden leg filling of $2\times2\times67$ cm would add a weight of more than 3 kg to that leg, and would thus give close to maximum leverage against wobbling because of the proximity of the weighted leg to its corner of the table. In other words, it would take an object weighing 3 kg placed at the very corner of opposite leg 4 to make the table wobble. If the object were placed closer to the center of table top 8, it would have to be even heavier than 3 kg to make the table wobble. Such a force is rarely encountered with tables where wobbling is a problem, for example when dishes are placed on tables in restaurants.

Leg 4 is shorter than the other legs. The length of leg 4 is determined by the maximum unevenness of floor 3 which can be expected. Variations in floor elevation rarely ever exceed $\pm0.5$ cm and therefore leg 4 generally needs to be 0.5 cm or less shorter than the other legs, which are preferably of equal length.

FIG. 2 shows a diagonal cross-section of the table of FIG. 1 through legs 4 and 6, illustrating an insert 10 of heavy metal in leg 6 and one type of an extending member 9 in leg 4.

Although FIG. 2 shows an embodiment of the present invention wherein a leg (leg 6) is weighted to make it heavier than the other legs, other embodiments will become obvious to those skilled in the art and such are intended to be encompassed by the spirit and scope of the appended claims. One such obvious embodiment comprises situating the weight in the table top 8 itself above or near the leg which is opposite the shorter leg containing the vertically extending member.

In FIG. 2, extending member 9 in short leg 4 is located in a hollowed portion of the leg as shown. Here, member 9 is free to move up and down and extends to floor 3 under the influence of gravity. The range over which the extendable member should be able to move is about twice the length difference between the shortened leg 4 and the other legs. For example if leg 4 is 3 mm shorter than the other legs, member 9 should be able to extend the leg up to 6 mm to be able to touch floor 3 with variations in floor elevation of at most ±3 mm. Extending member 9 conforms in shape to the hollow in which it moves vertically. In the embodiment shown in FIG. 2, the upper part of member 9 has an indented portion to create an overhanging ledge 11. The range of movement of extending member 9 is limited by the locations of the top of the hollow part of the leg and lip 12 which restricts the downward movement by virtue of the overhang 11 of the top part of member 9. Many other means of restricting the movement of extending member 9 should be obvious to those skilled in the art. If the moveable member has a footpad attached to the bottom which footpad limits the upward movement by being wider than the hollow part of the leg, it is understood that the length of the shortened leg in the above discussion includes the height of the footpad.

FIG. 3 is a partial cross-sectional view of leg 4 in the same direction as FIG. 2, but showing another embodiment of this invention wherein extending member 9 is spring-loaded by spring 13. The upward force provided by spring 13 at its maximum compression should not exceed half the weight of the entire table, lest it lift the table at leg 4 and cause wobbling between legs 5 and 7. For a table weighing 10 kg, this allows a force of 5 kg, and in the example of a 3 kg weighing insert in leg 6, a total force of up to 8 kg is available to oppose any wobbling under reasonable loads. However, in case of a temporary load exceeding the limit, such as caused by a person standing on top of the table, the tipping can be delayed by damping means such as viscous liquids retarding the movement of the insert. Such means to dampen movements such as those of a piston in a cylinder are well known. The description of the modification of the shortened leg in this paragraph merely illustrates a preferred embodiment of the invention. Other modifications will become obvious to those skilled in the art. Specifically, the present invention includes modifications of the shortened leg, in conjunction with weighting non-adjacent legs, by using an extension which automatically touches the floor under the force of gravity or some other force which may be provided by springs under compression or under extension, by compressed fluids, by magnetic or electric forces, etc. The extending member can be an insert as shown in the drawings or it can be an attachment capable of sliding inside the leg, or outside the leg, such as a sleeve; it can be open or closed at the bottom, with or without footpads or other means to resist sideways movement and/or to provide an aesthetically pleasing exterior.

I claim:

1. Wobble-resistant furniture for placement on a floor, said furniture having four essentially vertically disposed legs, one being shorter than three other substantially equal length legs and having a vertically extending member, one being positioned diagonally in relation to said shorter leg, wherein said diagonally positioned leg weighs more than any of the other legs b virtue of an additional metal component.

2. Furniture according to claim 1 wherein said extending member is spring-loaded.

3. Furniture according to claim 1 wherein said shorter leg is from 2 to 5 mm shorter than said other legs and the range over which the extending member is able to move is less than or equal to 10 mm.

* * * * *